US007854672B2

(12) United States Patent
Huang

(10) Patent No.: US 7,854,672 B2
(45) Date of Patent: Dec. 21, 2010

(54) STRUCTURE OF BALL

(76) Inventor: Yao-Jen Huang, 19F-7, No. 2, Chung Shan Erh Rd., Kaohsiung City (TW)

( * ) Notice: Subject to any disclaimer, the term of this patent is extended or adjusted under 35 U.S.C. 154(b) by 37 days.

(21) Appl. No.: 12/358,194

(22) Filed: Jan. 22, 2009

(65) Prior Publication Data

US 2010/0184542 A1 Jul. 22, 2010

(51) Int. Cl.
*A63B 37/12* (2006.01)

(52) U.S. Cl. ..... 473/598; 473/600

(58) Field of Classification Search ..... 473/598, 473/600–605

See application file for complete search history.

(56) References Cited

U.S. PATENT DOCUMENTS

| | | | | |
|---|---|---|---|---|
| 790,041 | A * | 5/1905 | Englerth et al. | 473/598 |
| 1,187,029 | A * | 6/1916 | Beebout | 473/604 |
| 1,502,784 | A * | 7/1924 | Kennedy | 473/598 |
| 1,861,157 | A * | 5/1932 | Grady | 473/598 |
| 1,980,472 | A * | 11/1934 | Clarke | 473/598 |
| 5,253,865 | A * | 10/1993 | Kinnee | 473/598 |
| 6,190,273 | B1 * | 2/2001 | Maxey et al. | 473/598 |
| 6,302,815 | B1 * | 10/2001 | Shishido et al. | 473/604 |
| 6,500,081 | B1 * | 12/2002 | Chen | 473/598 |
| 6,503,162 | B1 * | 1/2003 | Shishido et al. | 473/605 |
| 6,685,585 | B2 * | 2/2004 | Shishido et al. | 473/605 |
| 6,726,583 | B1 * | 4/2004 | Lai | 473/605 |
| 6,878,081 | B1 * | 4/2005 | Chen | 473/598 |
| 6,997,830 | B2 * | 2/2006 | Lin | 473/598 |
| 2006/0046880 | A1 * | 3/2006 | Tang et al. | 473/604 |

* cited by examiner

*Primary Examiner*—Steven Wong
(74) *Attorney, Agent, or Firm*—Leong C. Lei

(57) ABSTRACT

A ball includes a core and a surface cover that is formed by sewing together two shape-mated covering pieces. Each covering piece has a close-to-edge area defining inboards an inward circumferential zone in which spaced through apertures are defined. The through apertures are circumferentially distributed along the inward circumference of the close-to-edge area. The close-to-edge area has an outward circumference forming a turn-back section. The turn-back section is foldable over and attached to itself by adhesives so as to form a smooth and regular outer circumference of the covering piece. When the surface cover of the ball is completely sewn, a sewn portion between the two covering pieces shows a smooth and regular configuration so that no secondary finishing of the sewn portion of the covering pieces is needed. The manufacturing time of the ball can thus be shortened and the manufacturing costs reduced.

1 Claim, 7 Drawing Sheets

STRUCTURE OF BALL

TECHNICAL FIELD OF THE INVENTION

The present invention generally relates to a structure of a ball, and particularly to a ball structure that shortens the manufacturing time of the ball and substantially reduces the manufacturing costs of the ball.

DESCRIPTION OF THE PRIOR ART

A conventional baseball or softball, designated at 1, is illustrated in FIG. 1 of the attached drawings, and is generally constructed with a core 2 and a surface cover 3. The surface cover 3 is made up of two covering pieces 31 that mate each other. Each covering piece 31 has a close-to-edge area 312 defining inboards an inward circumferential zone in which spaced through apertures 311 are formed. The apertures 311 are distributed along an inward circumference of the close-to-edge area 312 of the covering piece 31. As shown in FIGS. 2 and 3, the manufacturing of the ball 1 is carried out by covering the core 2 with the two covering pieces 31 and a sewing needle A is used to extend a thread A1 by guiding the needle A to sequentially pass through the apertures 311 of the covering pieces 31 to thereby make the two covering pieces 31 closely mating each other and secured together. In this way, the surface cover 3 is formed and closely encloses the core 2. This is the general structure of the conventional ball 1.

Referring to FIG. 4, in the structure of the surface cover 3 of the conventional ball 1, the close-to-edge area 312 of the covering piece 31 will be put to project outward through the sewn portion when the two covering pieces 31 are tightly sewn together. This makes the surface cover 3 is a non-smooth and irregular condition. The close-to-edge area 312 of the covering piece 31 that projects outward may show a sharp edge, which deteriorates the quality of a commercial product of the ball. Even worse, since the close-to-edge area 312 of the covering piece 31 that projects outside presents a sharp edge exposed outside the surface cover 3, it makes a user very uncomfortable when he or she holds the ball 1. To overcome such a problem, a tool B, such as an awl, may be manually operated to push, in a portion by portion manner, the close-to-edge area 312 of the covering piece 31 that projects outward in a direction toward the core 2 and into below the covering piece 31 so as to hide the close-to-edge area 312 of the covering piece 31 under the covering piece 31 and thus making the joint 32 of the surface cover 3 a smooth and regular surface that shows no sharp edge.

Thus, the conventional ball 1 must be subjected to secondary finishing of the surface cover 3. Such a finishing operation is generally carried out manually in a portion by portion manner for each joint. The manufacturing time of the ball 1 is thus substantially extended and the costs for manufacturing the ball 1 are increased. Thus, it is desired to improve the conventional structure of balls in these respects.

SUMMARY OF THE INVENTION

A primary objective of the present invention is to provide a structure of a ball, which comprises a core and a surface cover that is formed by sewing together two shape-mated covering pieces. Each covering piece has a close-to-edge area defining inboards an inward circumferential zone in which spaced through apertures are defined. The through apertures are circumferentially distributed along the inward circumference of the close-to-edge area. The close-to-edge area has an outward circumference forming a turn-back section. The turn-back section is foldable over and attached to itself by adhesives so as to form a smooth and regular outer circumference of the covering piece. When the surface cover of the ball is completely sewn, a sewn portion between the two covering pieces shows a smooth and regular configuration so that no secondary finishing of the sewn portion of the covering pieces is needed. The manufacturing time of the ball can thus be shortened and the manufacturing costs reduced.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention will now be explained with reference to the drawings.

The present invention provides a ball, which is generally designated at 4. The ball 4 of the present invention comprises a core 5 and a surface cover 6. The present invention aims to improve the surface cover 6 of the ball and the improvement will be described.

Figure 1:
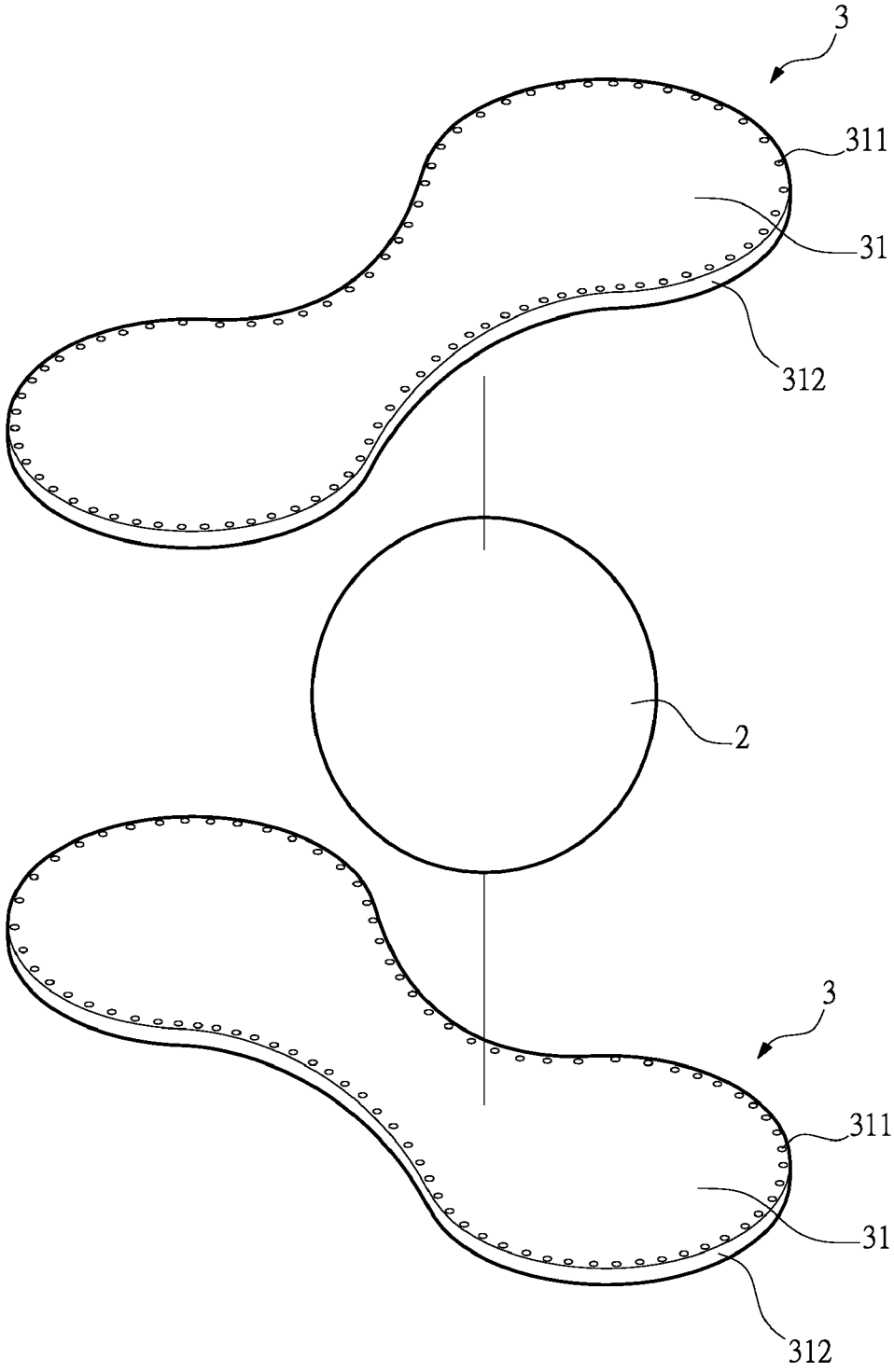
PRIOR ART FIG.1
FIG. 1 is an exploded view of a conventional ball.
Figure 2:
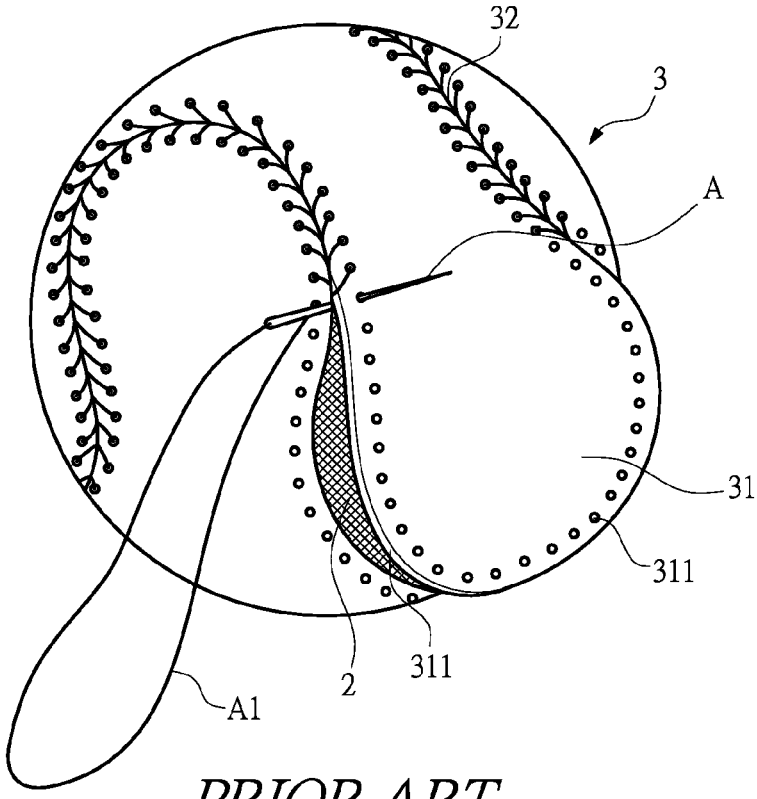
PRIOR ART FIG.2
FIG. 2 is a schematic view showing the sewing of the conventional ball.
Figure 3:
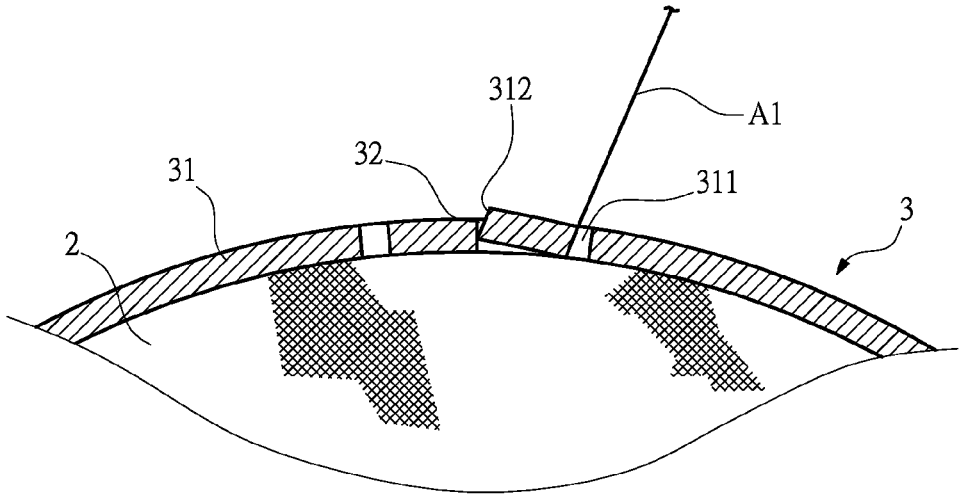
PRIOR ART FIG.3
FIG. 3 is a schematic enlarged view of a sewn portion of the conventional ball.
Figure 4:
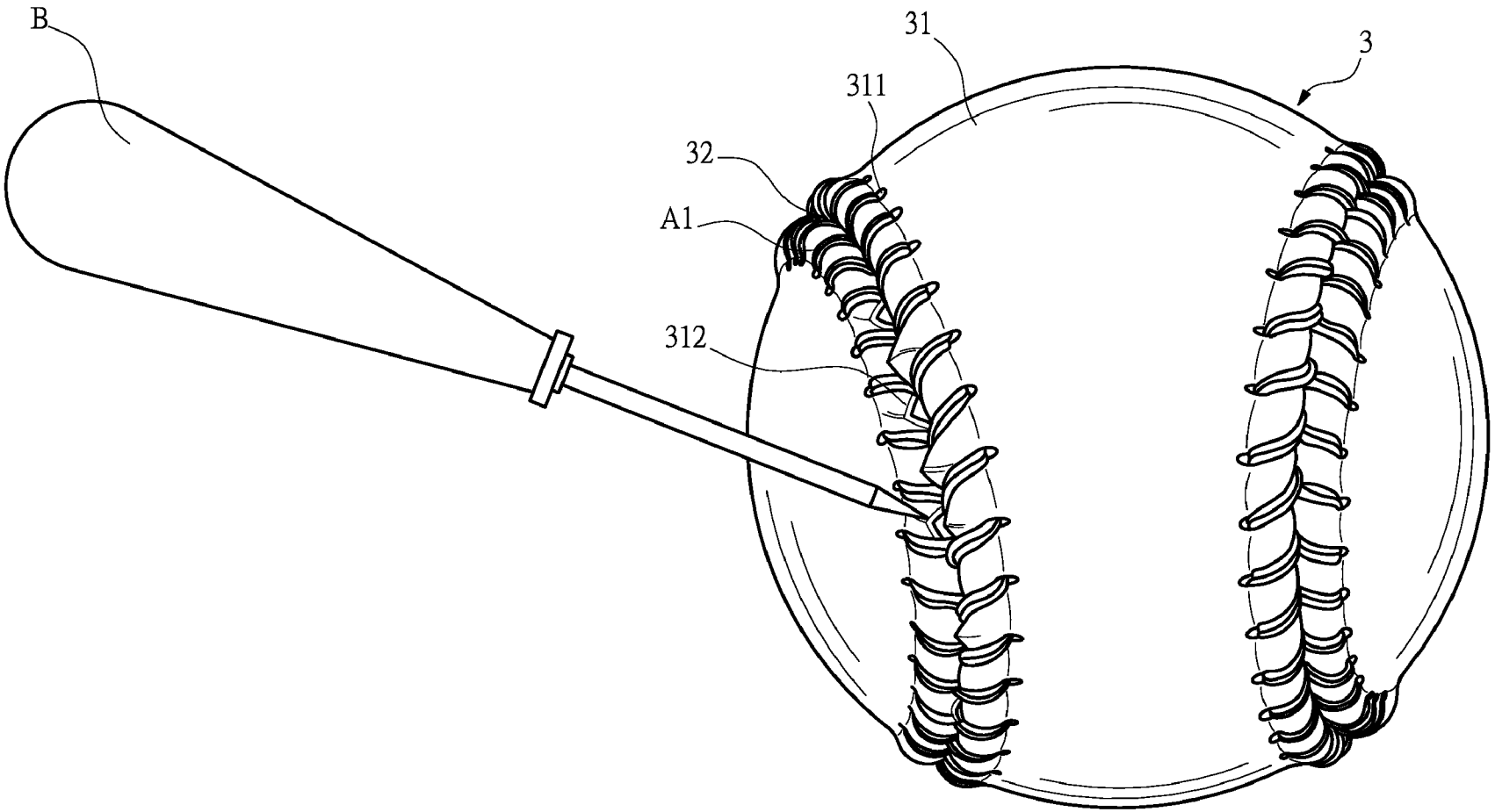
PRIOR ART FIG.4
FIG. 4 is a schematic view illustrating secondary finishing of the sewn portion of the conventional ball.
Figure 5:
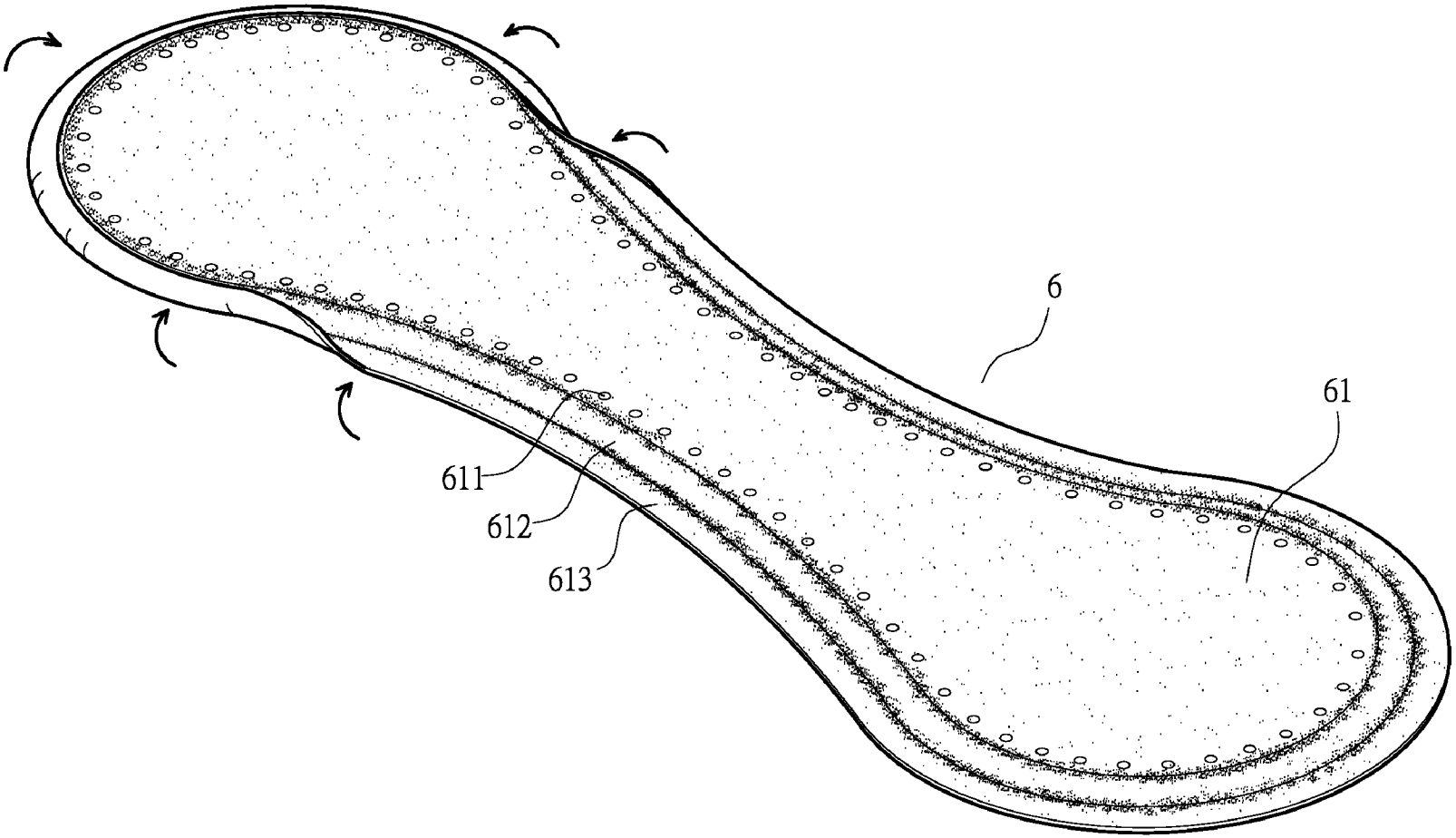
FIG. 5 is a perspective view showing a surface cover of a ball in accordance with the present invention.
Figure 6:
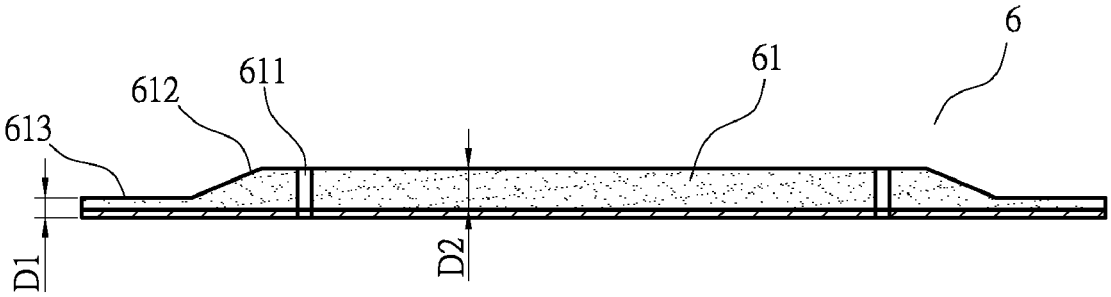
FIG. 6 is a cross-sectional view of the surface cover of the ball of the present invention.
Figure 7:
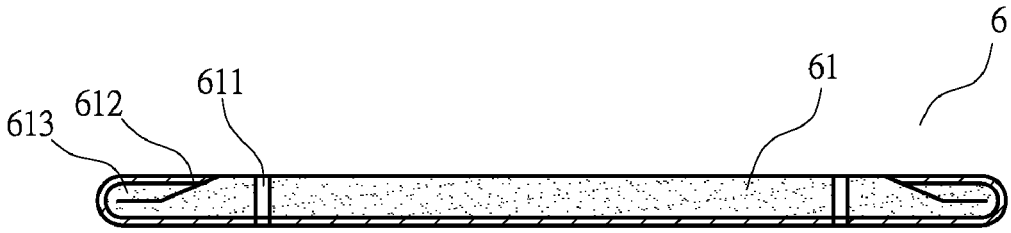
FIG. 7 is a cross-sectional view illustrating turn-back and adhesive securing of a turn-back section of the ball surface cover of the present invention.

Referring first to FIGS. 5-7, the surface cover 6 is made up of two covering pieces 61. Each covering piece 61 has a close-to-edge area 612 defining inboards an inward circumferential zone in which spaced through apertures 611 are formed. The apertures 611 are distributed along an inward circumference of the close-to-edge area 612 of the covering piece 61. An outward circumference of the close-to-edge area 612 forms a turn-back section 613. The turn-back section 613 has a thickness D1 that is less than thickness D2 of the covering piece 61. In other words, the thickness D1 of the turn-back section 613 is preferably one half of the thickness D2 of the covering piece 61. The turn-back section 613 has a width that is at least 1-3 mm. When the turn-back section 613 is turned back and folded over itself, the over thickness is substantially identical to the thickness of the covering piece 61 and the width of the covering piece 61 will not be enlarged, meaning a desired width that is previously used can be preserved.

Figure 8:
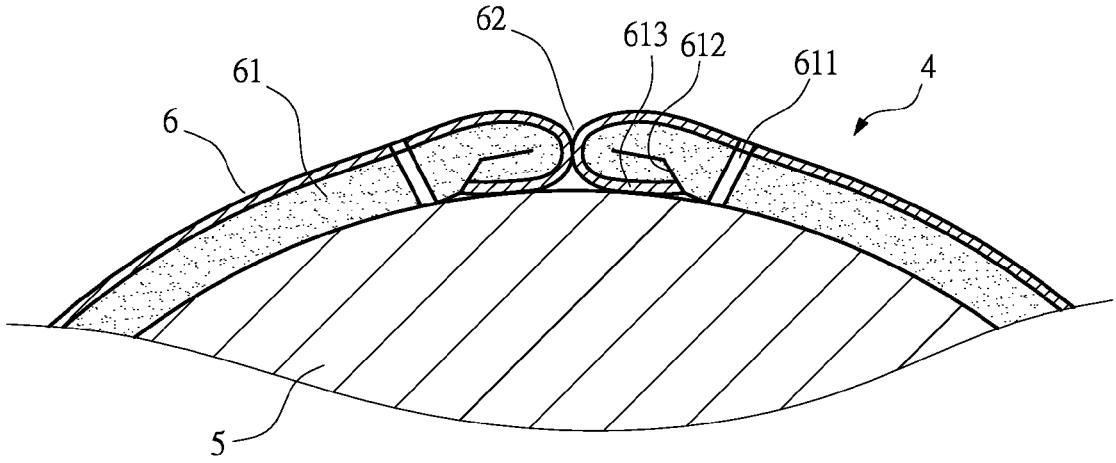
FIG. 8 is an enlarged cross-sectional view showing a sewn portion of the ball surface cover of the present invention.
Figure 9:
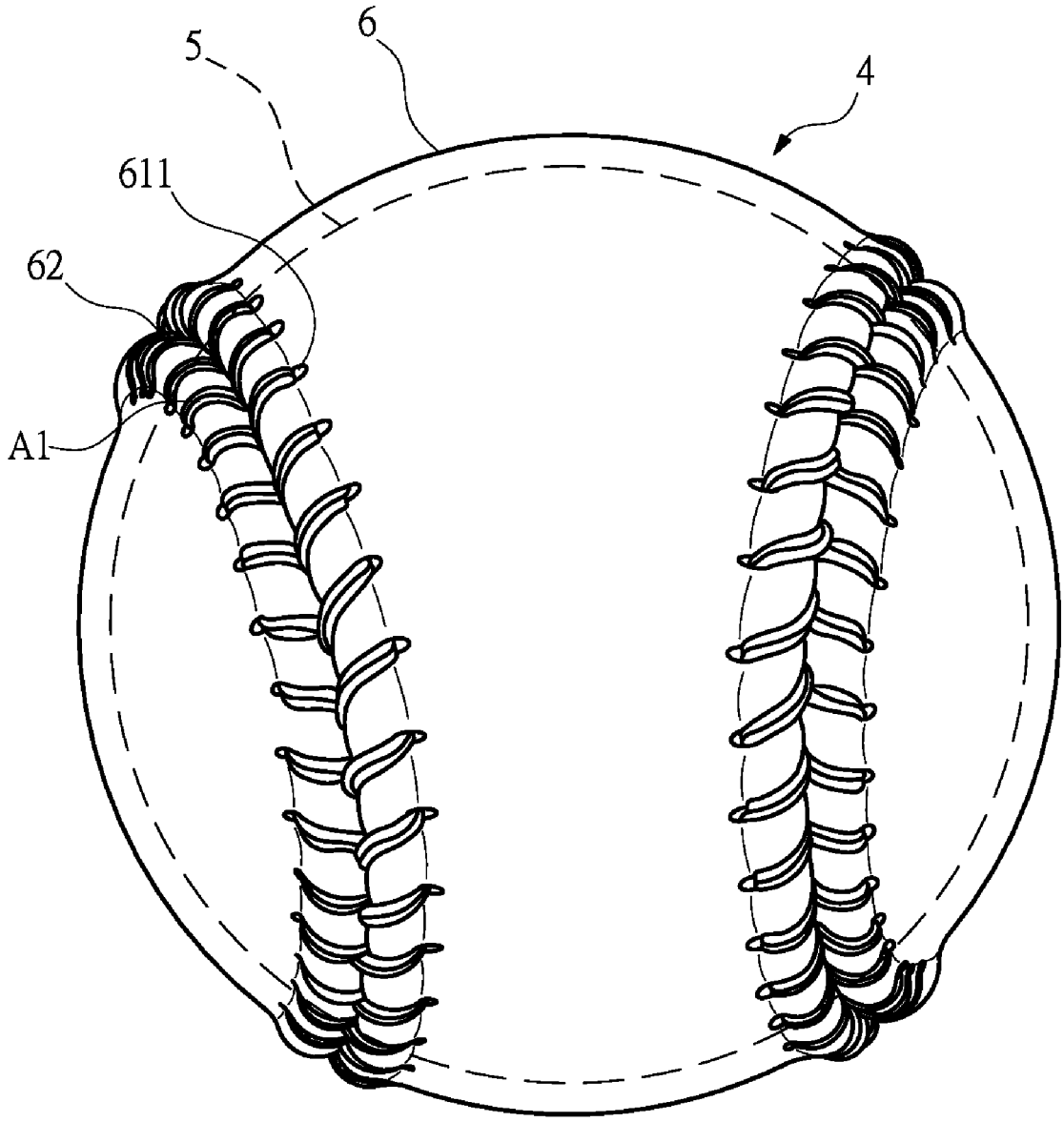
FIG. 9 is a perspective view of the ball in accordance with the present invention.

Referring to FIGS. 6-8, in practice, adhesive is first applied to the turn-back section 613 of the covering piece 61 and the turn-back section 613 is folded back to securely fix to itself by the adhesive. In this way, a circumferential edge of the covering piece 61 is made smooth and regular. Since in accordance with the present invention, the circumferential edge of the covering piece 61 is made smooth and regular first, when sewing the surface cover 6 in accordance with the present invention is completed, a joint 62 between the two covering pieces 61 shows a smooth and regular configuration. Thus, no additional finishing of the sewn portion of the covering piece 61 is needed, and consequently, the time period needed for making the ball 1 is effectively reduced.

The effectiveness of the present invention is that by providing a turn-back section 613 along a circumference of a covering piece 61 and further tuning back and adhesively attaching the turn-back section 613 to itself, the outer circumference of the covering piece 61 is made smooth and regular. In this way, after the surface cover 6 is sewn, the sewing portion between two covering pieces 61 shows a smooth and regular configuration and no secondary finishing of the joint 62 between the covering pieces 61 is needed. Thus, the manufacturing time of the ball 1 is shortened and the manufacturing costs of the ball 1 are substantially reduced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ball comprising:

a core; and a surface cover formed by sewing two shaped-mated covering pieces, each of said covering pieces having a close-to-edge area defining inboards an inward circumferential zone in which spaced through apertures are defined, said close-to-edge area having an inclined surface, said through apertures being circumferentially distributed along the inward circumference of said close-to-edge area;

wherein an outward circumference of said close-to-edge area forms a turn-back section, said turn-back section having a thickness that is one half of thickness of each of said covering pieces so that when said turn-back section is a turned back and folded overall itself, over thickness is identical to thickness of each of said covering pieces and width of said covering piece will not be enlarged, said a turn-back section having a width that is at least 1 mm.

* * * * *